US012708827B2

(12) United States Patent
Sorenson et al.

(10) Patent No.: US 12,708,827 B2
(45) Date of Patent: Aug. 18, 2026

(54) CRICKET BAT SWING TRAINER

(71) Applicants: James W. Sorenson, Evergreen, CO (US); Parker J. Sorenson, Evergreen, CO (US)

(72) Inventors: James W. Sorenson, Evergreen, CO (US); Parker J. Sorenson, Evergreen, CO (US)

(73) Assignee: Momentus Golf, Inc.

( * ) Notice: Subject to any disclaimer, the term of this patent is extended or adjusted under 35 U.S.C. 154(b) by 262 days.

(21) Appl. No.: 18/735,003

(22) Filed: Jun. 5, 2024

(65) Prior Publication Data

US 2025/0041693 A1 Feb. 6, 2025

Related U.S. Application Data

(63) Continuation-in-part of application No. 18/229,076, filed on Aug. 1, 2023, now Pat. No. 12,485,327.

(51) Int. Cl.
*A63B 69/00* (2006.01)
*A63B 71/06* (2006.01)

(52) U.S. Cl.
CPC ..... *A63B 69/0015* (2013.01); *A63B 71/0622* (2013.01); *A63B 2071/0633* (2013.01); *A63B 2209/08* (2013.01)

(58) Field of Classification Search
CPC ..... A63B 69/0015; A63B 71/0622; A63B 2071/0633; A63B 2209/08
USPC ..... 473/457
See application file for complete search history.

(56) References Cited

U.S. PATENT DOCUMENTS

| | | | | |
|---|---|---|---|---|
| 3,414,260 | A | 12/1968 | Gust | |
| 3,578,801 | A * | 5/1971 | Piazza | A63B 15/005 473/457 |
| 4,186,923 | A | 2/1980 | Garner et al. | |
| 7,056,240 | B2 * | 6/2006 | Brock | A63B 69/0002 473/457 |
| 7,147,580 | B2 * | 12/2006 | Nutter | A63B 69/0002 473/457 |
| 7,297,078 | B2 | 11/2007 | Libonati | |
| 8,540,584 | B1 | 9/2013 | Sorenson | |
| 9,687,718 | B1 | 6/2017 | Sorenson | |
| 9,757,635 | B1 | 9/2017 | Sorenson | |
| 12,485,327 | B2 * | 12/2025 | Sorenson | A63B 59/55 473/457 |
| 2005/0181896 | A1 | 8/2005 | Severa et al. | |
| 2008/0032829 | A1 | 2/2008 | Andrea et al. | |

(Continued)

*Primary Examiner* — Mitra Aryanpour
(74) *Attorney, Agent, or Firm* — McAfee & Taft: James F. Lee, III

(57) ABSTRACT

A trainer for practicing a proper cricket bat swing is shaped like a conventional cricket bat. A cavity with parallel side walls and toe and shoulder end walls extends through the trainer from its face to its swell. A weight freely reciprocates on a shaft aligned on the longitudinal axis of the cavity. The toe end of the cavity blocks sliding of the weight at the "sweet spot" of the trainer. When the trainer is swung in cricket bat fashion, the weight slides distally from the shoulder end wall and strikes the toe end wall of the cavity, providing audible indication of whether the contact of a conventional cricket bat with a bowled cricket ball would have occurred before, at or after the optimal ball-striking moment. A resistance device, such as a magnet, assists in proper placement of the weight prior to initiating user's swing.

24 Claims, 3 Drawing Sheets

(56) References Cited

U.S. PATENT DOCUMENTS

| | | | | |
|---|---|---|---|---|
| 2025/0041687 | A1* | 2/2025 | Sorenson | A63B 69/0015<br>473/457 |
| 2025/0041693 | A1* | 2/2025 | Sorenson | A63B 69/0002<br>473/457 |

* cited by examiner

CRICKET BAT SWING TRAINER

CROSS REFERENCE TO RELATED APPLICATIONS

This application is a Continuation-in-Part (CIP) of U.S. patent application Ser. No. 18/229,076 titled "CRICKET BAT SWING TRAINER," filed Aug. 1, 2023, the contents of which are hereby incorporated by reference.

FIELD OF THE INVENTION

This invention relates generally to sports training equipment and more particularly concerns a cricket bat swing trainer.

BACKGROUND OF THE INVENTION

A major factor in maximizing cricket batting effectiveness is achieving the maximum speed of the cricket bat "sweet spot" as simultaneously as possible with the moment of contact between the bat and the ball.

At present, cricket batting practice is accomplished by use of a conventional cricket bat to strike a bowled conventional cricket ball. Therefore, practice generally involves an expenditure of time by at least two players or an expensive machine and one player. Retrieval of balls and preparation of bowler and batter for each bowl and swing consumes much of a practice session. But there is no tool available for practicing the proper cricket batting swing that, when a proper swing occurs, confirms the success to the practicing batter.

It is, therefore, an object of this invention to provide a cricket batting swing trainer which facilitates individual practice sessions. It is also an object of this invention to provide a cricket batting swing trainer which eliminates the need for ball retrieval. A further object of this invention is to provide a cricket batting swing trainer which confirms whether contact of a bowled ball during a similar swing with a conventional cricket bat would occur before, at or after the optimal contact point of the bat with the ball. And it is an object of this invention to provide a cricket batting swing trainer which provides an audible signal indicative of the moment at which contact of a conventional cricket bat with a bowled cricket ball should have occurred.

SUMMARY OF THE INVENTION

In accordance with the invention, a trainer is provided for practicing a cricket bat swing to be made with an equivalent cricket bat.

The trainer is shaped generally like a conventional cricket bat. The trainer has an elongated handle and an elongated body. The body has a front face, a rear face and side edges and extends from shoulders at one end to a toe at the other end. The body joins at the shoulders to, and is aligned on a longitudinal axis with, the handle.

Unlike a cricket bat, the trainer has a cavity with parallel side walls and linear or arcuate, and preferably semi-circular, end walls. The cavity extends through the body from the front face to the rear face. The cavity is longitudinally dissected by the longitudinal axis of the handle and body. A shaft is aligned on the longitudinal axis and is secured at one end in the shoulders and at the other end in the toe of the body.

A weight having a width less than a width of the cavity is mounted for sliding reciprocation on the shaft. The toe end of the cavity is distanced from the shoulder end so that distal sliding of the weight is blocked when the weight reaches the "sweet spot" of the body. When the trainer is swung in cricket bat fashion, the weight slides distally from the shoulders of the body and strikes the toe end of the cavity. The weight striking the toe end of the trainer provides an audible indication of whether said weight has struck said toe end of said cavity before, at or after an optimal ball striking point of the swing.

The thickness of the body from the front face to the rear face is preferably less than the diameter of the weight. A padding may be mounted on the distal face of the toe of the body. The handle may be a conventional cricket bat handle. The rear face of the trainer may be a swell. If the trainer has a swell, the greatest thickness of the body along the swell is preferably less than the diameter of the weight. Preferably, the weight is cricket-ball-shaped.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION OF THE PREFERRED EMBODIMENTS

Figure 3:
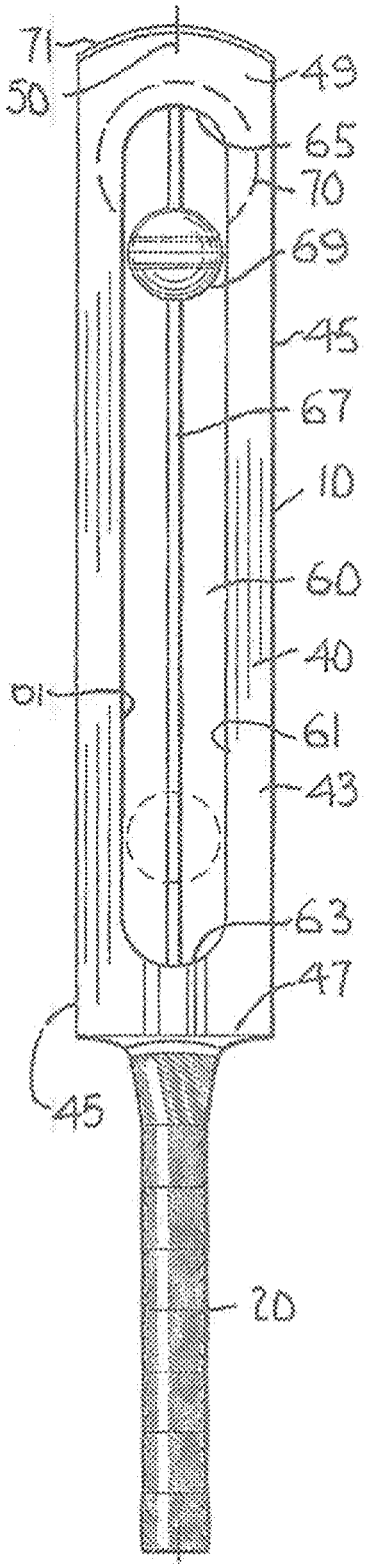
FIG. 3 is a rear elevation view of the cricket bat swing trainer of FIG. 1.
Figure 2:
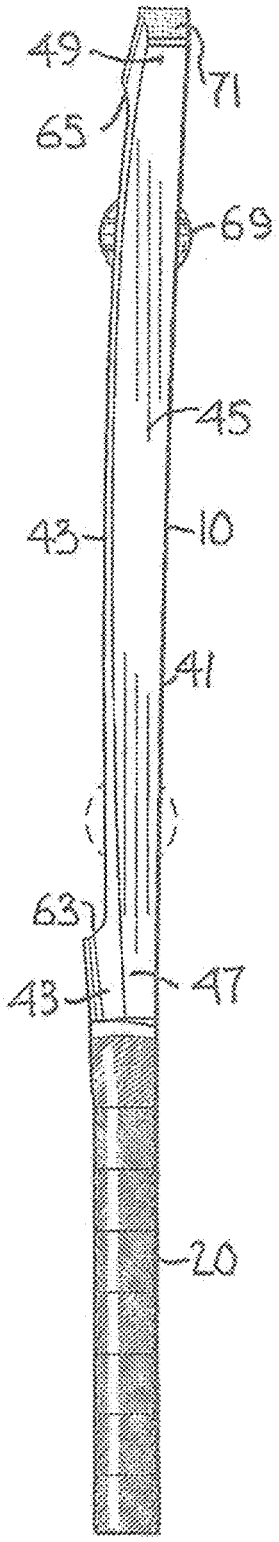
FIG. 2 is a left side elevation view of the cricket bat swing trainer of FIG. 1, the right side elevation view being the mirror opposite thereto.
Figure 1:
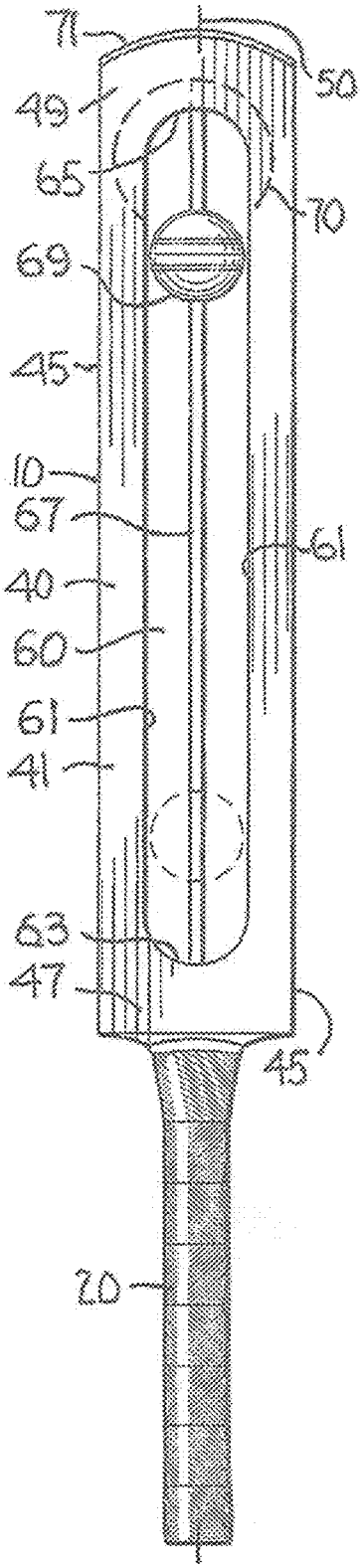
FIG. 1 is a front elevation view of a cricket bat swing trainer in accordance with the invention.

Turning first to FIGS. 1-3, a cricket bat swing trainer 10 is shaped generally like a conventional cricket bat. The trainer 10 has an elongated handle 20 and an elongated body 40. The body 40 has a front face 41 and a rear face 43 bounded by side edges 45. The body 40 extends from shoulders 47 at a proximal end of the body 40 to a toe 49 at a distal end of the body 40. The proximal end of the body 40 is joined at the shoulders 47 to the distal end of the handle 20. The handle 20 and body 40 are aligned on a longitudinal axis 50.

Unlike a cricket bat, the trainer 10 has a cavity 60 with parallel side walls 61 and proximal and distal end walls 63 and 65. The end walls 63 and 65 may be linear or arcuate.

As shown, they are semi-circular. The cavity 60 extends through the body 40 from the front face 41 to the rear face 43 and is longitudinally dissected by the longitudinal axis 60 of the handle 10 and body 20. A shaft 67 is aligned on the longitudinal axis 60 and is secured at one of its ends in the shoulders 47 and at the other of its ends in the toe 49 of the body 40.

A weight 69 having a width less than a width of the cavity 60 is mounted for sliding reciprocation on the shaft 67. As shown, the weight 60 is, but is not necessarily, shaped like a ball. As the weight 69 slides on the shaft 67, it does not make contact with the side walls 61. The distal or toe end 65 of the cavity 60 is distanced from the proximal or shoulder end 63 so that distal sliding of the weight 69 on the shaft 67 is blocked when the weight 69 reaches the "sweet spot" 70 of the body 40. The "sweet spot" 70 of the trainer 10 is the area on the trainer 10 that corresponds to the preferred ball-striking area on the face of an equivalent conventional cricket bat.

When the trainer 10 is swung in conventional cricket bat fashion, the weight 69 slides distally from the shoulders 47 of the body 40 and strikes the toe end 65 of the cavity 60. The weight 69 striking the toe end 65 of the trainer 10 provides an audible indication of whether the weight 69 has struck the toe end 65 of the cavity 60 before, at or after an optimal ball striking point of the conventional cricket bat swing. The optimal ball striking point of the swing is the point at which the wrist of the batter snaps to release the maximum velocity of the "sweet spot" 70 into contact with the ball.

Figure 4:
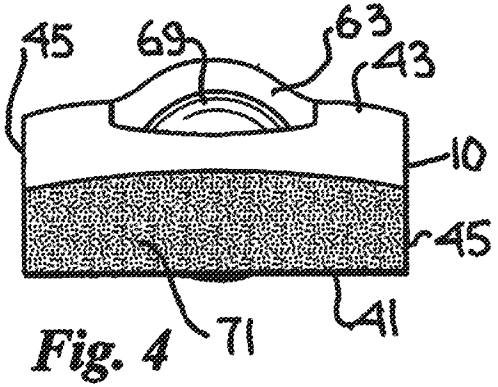
FIG. 4 is a top plan view of the cricket bat swing trainer of FIG. 1 at an enlarged scale.
Figure 6:
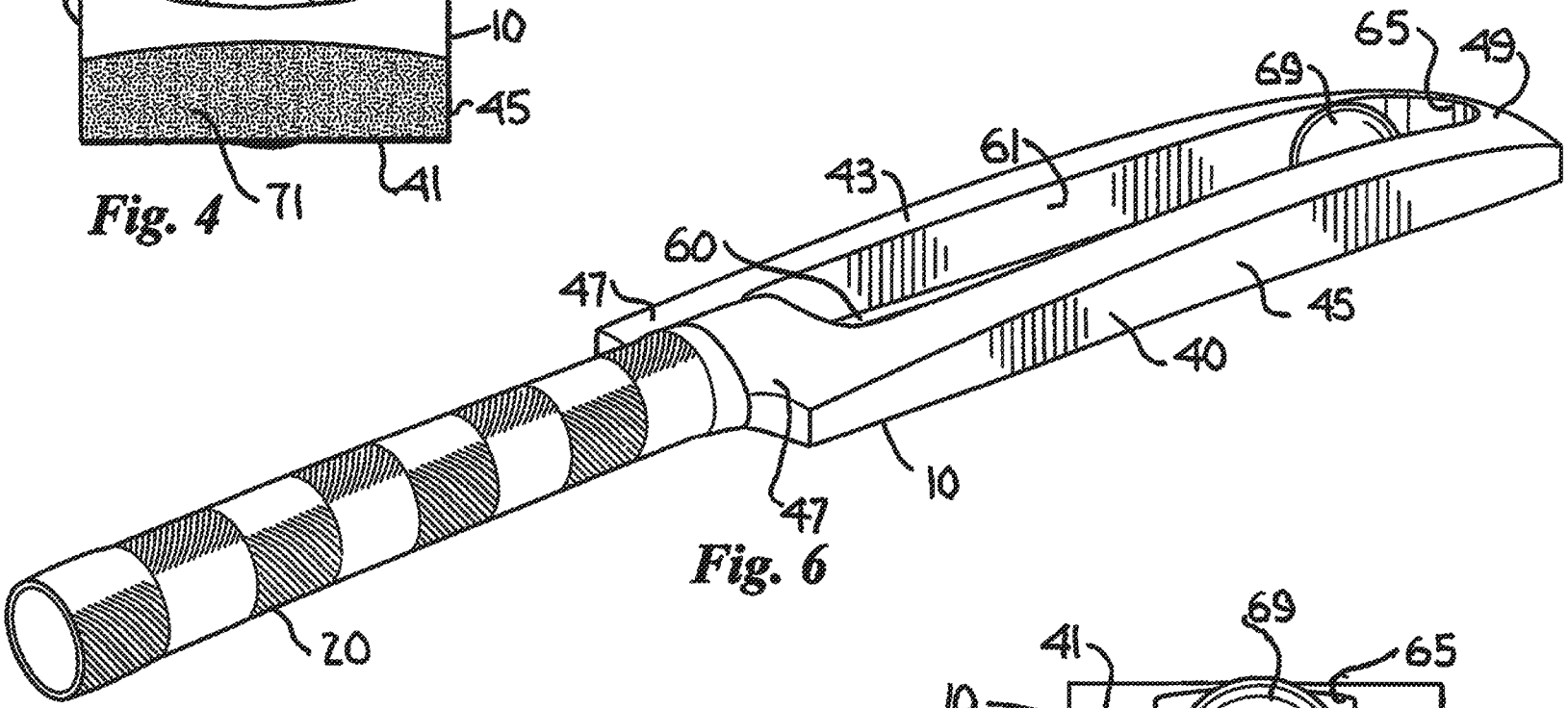
FIG. 6 is a perspective view showing the rear, left side and bottom of the cricket bat swing trainer of FIG. 1.
Figure 5:
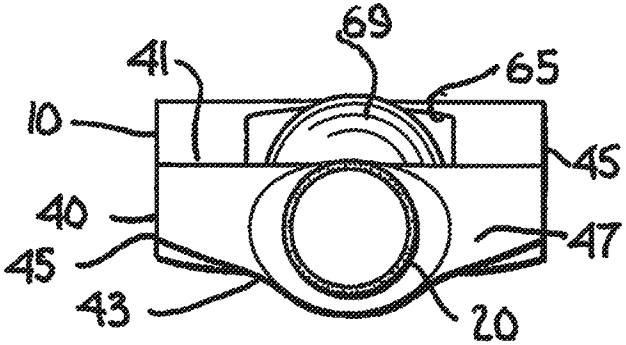
FIG. 5 is a bottom plan view of the cricket bat swing trainer of FIG. 1 at an enlarged scale.

Looking at FIGS. 4-6, the thickness of the body 40 from the front face 41 to the rear face 43 is preferably less than the width of the weight 69. A padding 71, seen in FIGS. 1-4, may be mounted on the distal face of the toe 49 of the body 40. The handle 10 may be a conventional cricket bat handle. Looking at FIGS. 2 and 4-6, the rear face 43 of the trainer 10 may be a swell. If the trainer 10 has a swell, the greatest thickness of the body 40 along the swell is preferably less than the width of the weight 69. Preferably, the weight 69 is cricket-ball-shaped in proportion to the associated cricket bat size.

Short handle and long handle full size cricket bats are 33½" or 34¾" long for batters 5'-8"+ or 6'-3"+ and have 4¼" wide faces. Lengths may be as short as 25¼" and widths as narrow as 3.5" depending on the height of the batter. The selected trainer 10 would be dimensioned to correspond to the chosen bat size of the user, provided the length of the trainer face 41 is sufficient to accommodate a cavity 60 of suitable length as above described.

Figure 7:
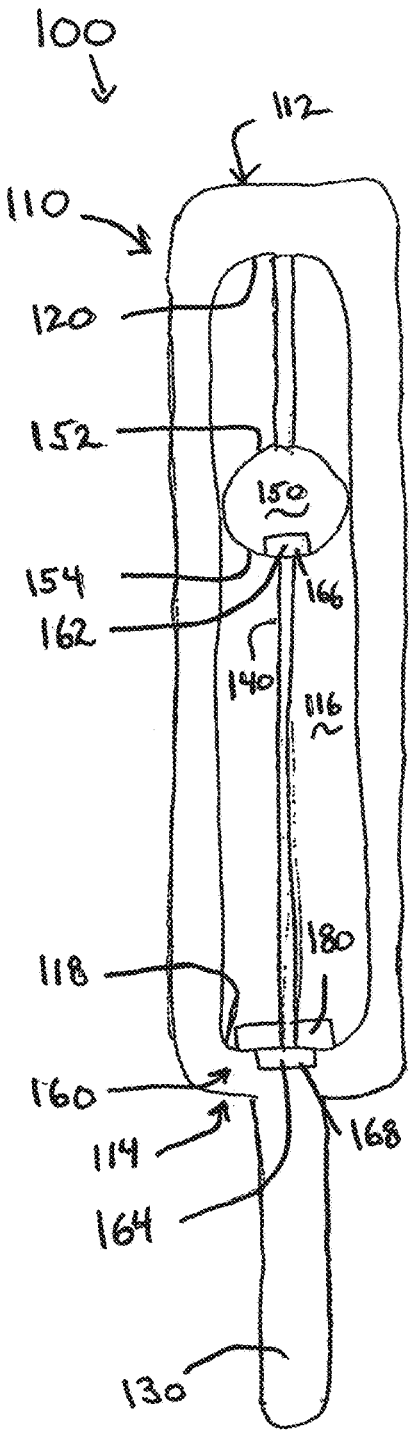
FIG. 7 is a front elevation view of a second embodiment of a cricket bat swing trainer having a resistance mechanism proximate to the handle.
Figure 8:
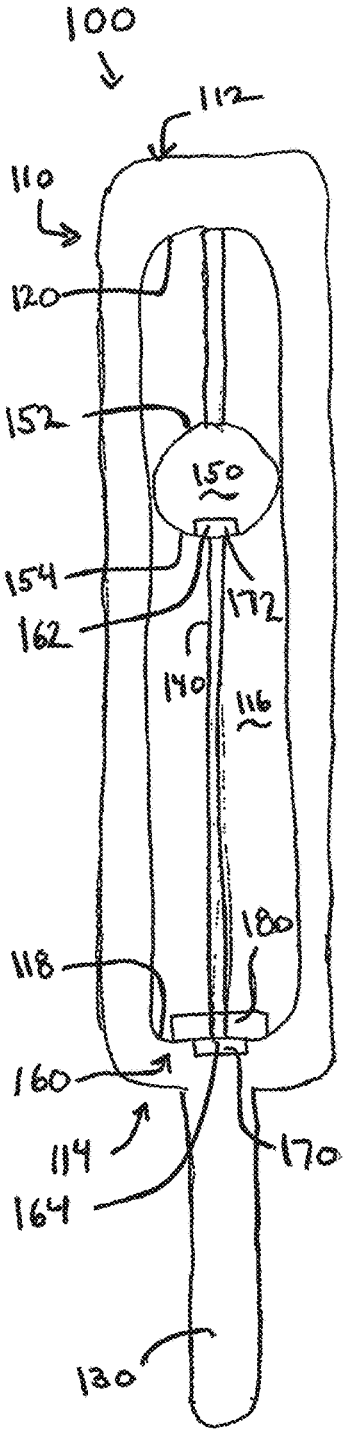
FIG. 8 is a front elevation view of a second embodiment of a cricket bat swing trainer having a resistance mechanism proximate to the handle.
Figure 9:
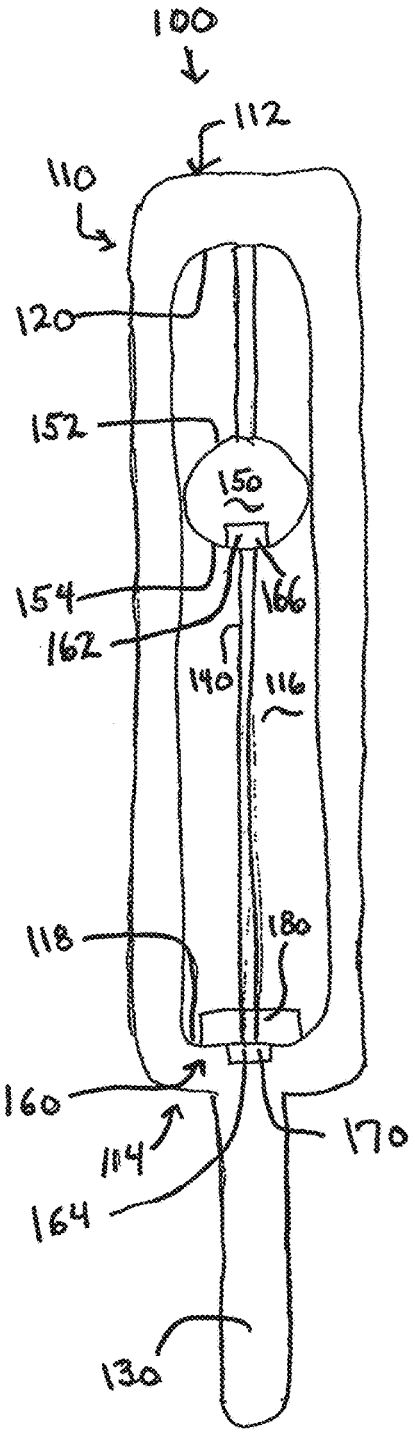
FIG. 9 is a front elevation view of a second embodiment of a cricket bat swing trainer having a resistance mechanism proximate to the handle.

Referring now to FIGS. 7-9, shown is an alternate embodiment of cricket bat 100. Cricket bat 100 has a body 110 having a toe end 112 and a handle end 114. Body 110 defines cavity 116. Cavity 116 defines a proximal end wall 118 and a distal end wall 120.

Cricket bat 100 is provided with handle 130 that is affixed to handle end 114 of body 110. Shaft 140 extends from distal end wall 120 of cavity 116 to proximal end wall 118 of cavity 116.

Weight 150 is slidably received on shaft 140. Weight 150 is slidable from distal end wall 120 to proximal end wall 118 of cavity 116. Weight 150 has a first side 152 facing distal end wall 120. Weight 150 has a second side 154 facing proximal end wall 118 of cavity 116. In one embodiment, weight 150 is a sphere. In a preferred embodiment, weight 150 has a size of a conventional cricket ball.

Resistance device 160 is provided proximate to proximal end wall 118 of cavity 116 for temporarily holding weight 150 adjacent to proximal end wall 118 e.g., for assisting with proper placement of weight 150 prior to initiating a user's swing. In one embodiment, resistance device 160 includes traveling member 162 and stationary member 164. In one embodiment, resistance device 160 includes a magnet. In one embodiment, resistance device 160 includes a magnet and a ferromagnetic member.

In one embodiment, travelling member 162 is traveling magnet 166 that is affixed to weight 150 and stationary member 164 is stationary ferromagnetic member 168 wherein stationary ferromagnetic member 168 is affixed to body 110 adjacent to proximal end wall 118 of cavity 116 (see, e.g., FIG. 7).

In one embodiment, stationary member 164 is stationary magnet 170 affixed to body 110 adjacent to proximal end wall 118 of cavity 116. Traveling member 162 is traveling ferromagnetic member 172 affixed to weight 150 (see, e.g., FIG. 8).

In one embodiment, stationary member 164 is stationary magnet 170 and traveling member 162 is traveling magnet 166 (see, e.g., FIG. 9).

In one embodiment, stationary magnet 170 is affixed to body 110 wherein stationary magnet 170 is located adjacent to proximal end wall 118 of cavity 116. In one embodiment, traveling magnet 166 is affixed to weight 150, wherein traveling magnet 166 is adjacent to second side 154 of weight 150.

In one embodiment, cushion member 180 is provided between stationary member 164 and traveling member 162. Cushion member 180 may be secure to proximal end wall 118 of cavity 116. In one embodiment, cushion member 180 is a washer. In another embodiment, cushion 180 is comprised of rubber.

Thus, it is apparent that there has been provided, in accordance with the invention, a cricket bat swing trainer that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall in the spirit of the appended claims.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A cricket bat swing trainer comprising:

an elongated handle;

an elongated body, said body having a front face and a rear face and side edges extending from shoulders at a shoulder end to a toe at a toe end, said body being joined at said shoulders to, and aligned on a longitudinal axis with, said handle;

a cavity having a proximal end wall, a distal end wall, and parallel side walls, said cavity extending through said body from said front face to said rear face and defining a width between said parallel side walls, said cavity being longitudinally dissected by said longitudinal axis;

a shaft aligned on said longitudinal axis and secured at one end in said proximal end wall of said cavity and at another end in said distal end wall of said cavity;

a weight having a width less than said width of said cavity and mounted for sliding reciprocation on said shaft, a distal end wall of said cavity being distanced from proximal end wall of said cavity, so that distal sliding of said weight is blocked when said weight reaches a "sweet spot" of said body, whereby said weight striking said distal end wall of said cavity provides an audible indication of whether said weight has struck said distal end wall of said cavity before, at or after an optimal ball striking point of a user's swing; and wherein a greatest thickness of said body from said front face to said rear face being less than a diameter of said weight a resistance device proximate to said proximal end wall for temporarily holding said weight adjacent to said proximal end wall for assisting with proper placement of said weight prior to initiating a user's swing.

2. The trainer according to claim 1 wherein:

said weight having a shape of a conventional cricket ball.

3. The trainer according to claim 1 wherein:

said proximal end wall and said distal end wall of said cavity being semi-circular.

4. The trainer according to claim 1 wherein:

said resistance device comprises a travelling member and a stationary member.

5. The trainer according to claim 1 wherein:

said resistance device comprises a magnet.

6. The trainer according to claim 4 wherein:

said resistance device comprises a magnet and a ferromagnetic member.

7. The trainer according to claim 4 wherein:

said travelling member is a magnet affixed to said weight and wherein said stationary member is a stationary ferromagnetic member affixed to said body adjacent said proximal end wall of said cavity.

8. The trainer according to claim 4 wherein:

said stationary member is a magnet affixed to said body adjacent said proximal end wall of said cavity and said travelling member is a travelling ferromagnetic member affixed to said weight.

9. The trainer according to claim 4 wherein:

said stationary member is a stationary magnet and wherein said travelling member is a travelling magnet.

10. The trainer according to claim 9 wherein:

said stationary magnet is affixed to said body, said stationary magnet adjacent to said proximal end wall of said cavity.

11. The trainer according to claim 9 wherein:

said weight has a second side that faces said proximal end wall of said cavity;

said travelling magnet is affixed to said weight, adjacent to said second side of said weight.

12. The trainer according to claim 9 further comprising:

a cushion between said stationary member and said traveling member, wherein said cushion is secured to said proximal end wall of said cavity.

13. A cricket bat comprising:

a body defining a toe end, a handle end, and a cavity, said cavity defining a distal end wall proximate said toe end of said body, said cavity defining a proximal end wall proximate said handle end of said body;

a handle affixed to said handle end of said body;

a shaft extending from said distal end wall of said cavity to said proximal end wall of said cavity;

a weight slidably received on said shaft, said weight slidable from said distal end wall to said proximal end wall, said weight having a first side facing said distal end wall and a second side facing said proximal end wall of said cavity;

wherein a greatest thickness of said body from said front face to said rear face being less than a diameter of said weight; and a resistance device proximate said proximal end wall of said cavity for temporarily holding said weight adjacent to said proximal end wall.

14. The trainer according to claim 13:

wherein said weight is a sphere.

15. The trainer according to claim 13:

wherein said weight has a size of a conventional cricket ball.

16. The cricket bat according to claim 13 wherein:

said resistance device comprises a travelling member and a stationary member.

17. The cricket bat according to claim 13 wherein:

said resistance device comprises a magnet.

18. The cricket bat according to claim 13 wherein:

said resistance device comprises said magnet and a ferromagnetic member.

19. The cricket bat according to claim 16 wherein:

said travelling member is a traveling magnet affixed to said weight and wherein said stationary member is a stationary ferromagnetic member affixed to said body adjacent said proximal end wall of said cavity.

20. The cricket bat according to claim 16 wherein:

said stationary member is a stationary magnet affixed to said body adjacent said proximal end wall of said cavity and said travelling member is a travelling ferromagnetic member affixed to said weight.

21. The cricket bat according to claim 16 wherein:

said stationary member is a stationary magnet and wherein said travelling member is a travelling magnet.

22. The cricket bat according to claim 21 wherein:

said stationary magnet is affixed to said body, said stationary magnet is adjacent to said proximal end wall of said cavity.

23. The cricket bat according to claim 21 wherein:

said travelling magnet is affixed to said weight, said travelling magnet is adjacent to said second side of said weight.

24. A cricket bat swing trainer comprising:

an elongated handle;

an elongated body, said body having a front face, a rear swell and side edges extending from shoulders at one end to a toe at another end, a greatest thickness of said body from said front face to said swell being less than a diameter of a conventional cricket ball, said body being joined at said shoulders to, and aligned on a longitudinal axis with, said handle;

a cavity having parallel side walls and semi-circular ends extending through said body from said front face to said swell, a diameter of said semi-circular ends being greater than the diameter of a conventional cricket bail, said cavity being longitudinally dissected by said longitudinal axis;

a shaft aligned on said longitudinal axis and secured at one end in said shoulders and at another end in said toe; and a cricket-ball shaped weight having a diametric hole for sliding reciprocation on said shaft, a toe end of said cavity being distanced from a shoulder end of said cavity so that distal siding of said weight is blocked when said weight reaches a "sweet spot" of said body, whereby said weight striking said toe end of said cavity provides an audible indication of whether said weight has struck said toe end of said cavity before, at or after an optimal ball striking point of the swing; and a resistance device proximate said proximal end wall of said cavity for temporarily holding said weight adjacent to said proximal end wall.

* * * * *